United States Patent [19]

Bol et al.

[11] Patent Number: 4,982,648

[45] Date of Patent: Jan. 8, 1991

[54] GUN BARREL COOLING ARRANGEMENT

[75] Inventors: Johannes Bol, Heppenheim; Manfred Schildknecht, Friedrichsdorf, both of Fed. Rep. of Germany

[73] Assignee: Battelle-Institut e.V., Frankfurt, Fed. Rep. of Germany

[21] Appl. No.: 123,246

[22] Filed: Nov. 20, 1987

[30] Foreign Application Priority Data

Nov. 21, 1986 [DE] Fed. Rep. of Germany ..... 3639866

[51] Int. Cl.[5] ..... F41A 21/44; F41A 21.02

[52] U.S. Cl. ..... 89/14.1; 89/16; 42/76.02

[58] Field of Search ..... 89/14.1, 14.05, 16; 42/70.01, 76.02

[56] References Cited

U.S. PATENT DOCUMENTS

| | | | |
|---|---|---|---|
| 308,399 | 11/1884 | Babbitt | 89/16 |
| 1,337,971 | 4/1920 | Watkins | 89/14.1 |
| 2,287,066 | 6/1942 | Rogers | 89/14.05 |
| 2,850,828 | 9/1958 | Sullivan | 42/76.02 |
| 3,777,385 | 12/1973 | Hagan | 42/75.01 |
| 4,424,734 | 1/1984 | Janssen et al. | 89/16 |

FOREIGN PATENT DOCUMENTS

| | | | |
|---|---|---|---|
| 85270 | 9/1921 | Austria . | |
| 487229 | 11/1929 | Fed. Rep. of Germany | 89/14.1 |
| 1918422 | 10/1970 | Fed. Rep. of Germany . | |
| 3046639 | 7/1982 | Fed. Rep. of Germany . | |
| 3135586 | 3/1983 | Fed. Rep. of Germany . | |
| 504091 | 6/1920 | France | 89/14.1 |
| 860073 | 1/1941 | France | 89/14.1 |
| 1002098 | 3/1952 | France | 89/14.1 |
| 1202504 | 1/1960 | France . | |
| 457193 | 7/1968 | France . | |
| 409625 | 2/1945 | Italy | 89/16 |
| 20938 | 6/1904 | Sweden | 89/14.05 |
| 177023 | 10/1961 | Sweden | 89/14.1 |
| 457193 | 7/1968 | Switzerland . | |
| 7071 | 3/1895 | United Kingdom | 89/16 |
| 127264 | 6/1919 | United Kingdom | 89/14.1 |
| 234835 | 10/1925 | United Kingdom | 89/14.1 |
| 603976 | 6/1948 | United Kingdom . | |

*Primary Examiner*—Charles T. Jordan
*Assistant Examiner*—Stephen Johnson
*Attorney, Agent, or Firm*—Spencer & Frank

[57] ABSTRACT

An arrangement for cooling the gun barrel of a combat tank wherein the gun barrel is provided with helical cooling channels on its outer surface, and an insulation layer on at least the inner circumferential surfaces of the cooling channels. This reduces the IR signature of the gun barrel during combat and avoids deformation of the barrel under the influence of radiation from the sun.

19 Claims, 4 Drawing Sheets

GUN BARREL COOLING ARRANGEMENT

BACKGROUND OF THE INVENTION

1. Field of the Invention

The present invention relates to a cooling arrangement for a gun barrel and more particularly for a gun barrel of a combat tank.

When projectiles are fired, the gun barrel of a combat tank is heated by the combusted fuel of the projectile. The heated barrel constitutes a clearly recognizable object for thermal imaging devices. Specifically, the infrared (IR) signature of a combat tank whose gun barrel has been heated from firing is particularly distinct to these thermal imaging devices. Therefore, to avoid detection by the thermal imaging devices it is desirable to cool the gun barrel surface to ambient temperature as quickly as possible after firing, or to prevent, from the start, the gun barrel surface temperature from rising too much.

A further heating problem encountered with gun barrels results when the gun barrel is subjected to the radiation of the sun, and is therefore only heated from one side. This radiation heating from one side causes the barrel to bend or deform to the extent that there develops a deviation between the optical axes of the aiming device and the actual direction of firing. To prevent this deformation of the barrel, and the resulting deviation between the aiming device and the direction of firing, the barrel should be substantially shielded against exposure to the sun. In addition, if there is any remaining heat reaching the body of the barrel, this heat must be distributed uniformly over the circumference of the barrel.

Particular difficulties result in solving these problems because of the actual function and operation of a gun barrel. For example, all devices fastened to the barrel must be able to withstand the great forces generated during recoil of the barrel. The recoil acceleration force for the 120 mm smooth barrel cannon employed by the Leopard 2 tank is of the order of magnitude of 300 g with the barrel recoiling about 0.3 m. Over this recoiling length, the barrel must be freely movable within the guides provided for this purpose. Moreover, one type of device that is normally mounted on the gun barrel is a smoke extraction device. Conventionally, the smoke extraction device is pushed in the manner of a sleeve over the part of the barrel that projects freely from the turret. If a cooling device is utilized to overcome other problems of the barrel, the smoke extraction device constitutes an impediment which must be overcome or bridged. If possible, the smoke gas extraction device should be included in the components being cooled.

2. Discussion of the Prior Art:

A gun barrel for a combat tank which is equipped with insulation tubes made of glass fiber reinforced plastic is known. This known arrangement reduces the temperature of the outer surface of the gun barrel to some extent and thus reduces the IR heat radiation when the barrel is hot from firing. If the gun barrel is exposed to the sun, the glass fiber reinforced plastic insulation tubes shield the gun barrel against some of the irradiated heat. However, the thermal insulation provided by the glass fiber reinforced plastic tubes is neither sufficient to protect the barrel against IR detection when it is hot from firing, nor from deformation or bending of the barrel when it is exposed to the radiation of the sun. Additionally, the problems encountered in mechanically fastening the glass fiber reinforced plastic tube to the gun barrel have not yet been completely solved.

SUMMARY OF THE INVENTION

It is an object of the present invention to provide a gun barrel, particularly for a combat tank, which is distinguished by a noticeable reduction in its IR signature after firing.

It is another object of the present invention to provide a gun barrel in which deformation of the barrel under the influence of the sun's radiation is avoided substantially or completely.

The above objects are generally achieved according to the present invention by providing cooling channels for the flow of a cooling fluid, particularly air, on the outer surface of the gun barrel, with these channels extending uniformly and helically over the circumference and the length of the gun barrel, and by providing a thermal insulating layer on at least the inner circumferential surface of the cooling channels.

The cooling channels are preferably charged with cooling air by way of a blower mechanism which is preferably attached near the barrel. Advantageously, as indicated above the cooling channels extend around the gun barrel in helixes, although a ring of axially parallel cooling channels may also be provided for the purpose of reducing the IR signature.

In one embodiment of the invention, the cooling channels are formed by grooves made directly in the outer surface or wall of the barrel (external rifling) with a thin-walled tube pushed over the gun barrel to close the grooves and thereby define the outer walls of the cooling channels. In this embodiment, the entire outer surface of the gun barrel with the grooves cut in may be coated with the heat insulating layer before the outer tube is applied. One example of this heat or thermal insulating layer is a ceramic material which, for example, is sputtered on by means of a plasma spraying process.

According to another embodiment of the invention, the cooling channels are formed by supporting webs which are each applied to the circumferential outer surface of the barrel in the form of a helix, and a thin-walled tube pushed over the webs. Before the Webs are applied to the barrel a layer of material having low heat conductivity, i.e., the thermal insulating layer, may be applied first to the outer surface of the gun barrel.

A further possibility of forming cooling channels which wind helically around a gun barrel is to cover the gun barrel with an outer tube having helical grooves cut into its interior surface (internal rifling). In this embodiment, as well as with the ones described earlier, a heat insulating layer may be applied first to the gun barrel.

A blowing mechanism or fan installed in the interior of the turret or on the exterior of the weapon cradle can blow air toward the front of the barrel or sucks it from the front end to the rear end through the helical cooling channels formed around the barrel.

As a result of the insulating layer disposed between the cooling channels and the gun barrel, it is possible to cool the outer barrel cover or tube and/or to bring it to ambient temperature while the gun barrel itself still remains warm.

Due to the fact that the cooling channels are brought around the barrel in helixes, any thermal radiation from the sun that contacts the barrel on one side only is distributed uniformly over the barrel's circumference.

If there is thermal radiation from the sun, the insulating layer located between the cooling channels and the gun barrel has the effect that the incoming thermal energy is dissipated by the air blown through the cooling channels and the radiation heat leaves without heating the wall of the gun barrel itself.

The connection of the cooling channels to the blower mechanism is accomplished by an air distribution chamber adjacent the rear end of the barrel. The housing defining this distribution chamber may have a telescoping configuration so that it is able to be pushed together when the barrel recoils after firing. The distribution chamber housing as a whole may also be formed of a flexible material to allow it to adapt to the recoil action of the barrel. A flexible hose connection is preferably disposed between the distribution chamber and the blower so that the blower can be installed at a location where it will not move during barrel recoil.

Bridging of the smoke extractor of the gun barrel by cooling air is also possible by means of one or a plurality of intermediate chambers which communicate with the cooling channels. The smoke extractor is preferably mounted so that it can be pushed off the barrel in the forward direction for the purpose of cleaning or repair in a manner similar to the procedure used in prior art gun barrels. The smoke extractor region is then included in the areas being cooled.

The present invention therefore provides the following advantages over the prior art:

(1) The cooling channels form a structural unit with the outer surface of the gun barrel. The structural elements which are constituted by the gun barrel, the insulating layer, the outer skin or tube and any supporting webs are connected with one another at their contacting faces over the entire length of the barrel. The inertial forces generated during recoil are distributed uniformly over the connection surfaces, thereby providing that no individual fastening locations are subjected to great mechanical forces caused by the recoiling barrel.

(2) The helical cooling channels located around the gun barrel produce uniform temperatures over the circumference of the gun barrel, thereby avoiding deformation of the gun barrel due to uneven heating or cooling.

(3) The insulation layer between the gun barrel and the cooling channels makes it possible to bring the outer skin or tube covering the cooling channels to ambient temperature or to keep it at ambient temperature without having to quickly dissipate all of the thermal energy collected in the barrel.

(4) The insulating layer also causes the irradiated thermal energy from solar radiation to be removed by the cooling air before it reaches one side of the wall of the gun barrel.

(5) The telescoping configuration of the distribution chamber housing disposed adjacent the rear end of the gun barrel and through which the cooling channels are supplied with air, or the flexible wall configuration of the housing (for example a bellows configuration), permits unimpeded recoil of the gun barrel. The blower which conveys the air through the cooling channels should preferably be mounted so that it is not subjected to the acceleration forces of barrel recoil. For example, the blower may be mounted on the gun barrel support.

(6) Further distribution chambers make it possible to include the smoke extractor in the components being cooled without interfering with its function or interfering with its disassembly for maintenance purposes.

DESCRIPTION OF THE PREFERRED EMBODIMENTS

Figure 1:
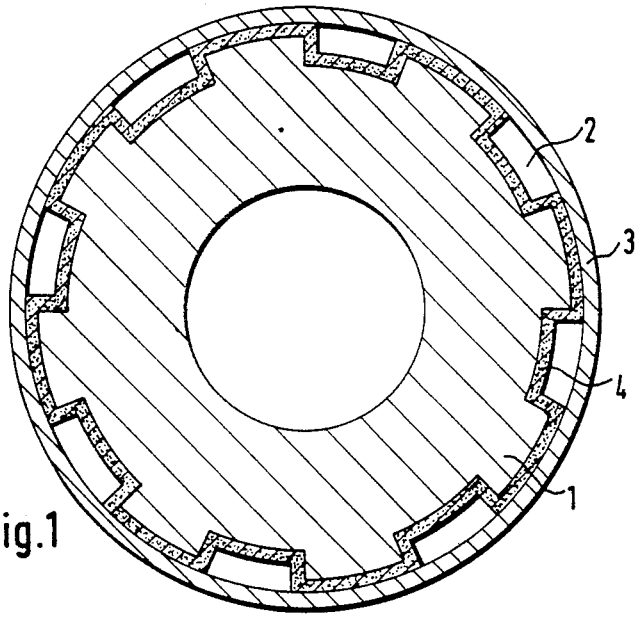
FIG. 1 is a cross-sectional view of a gun barrel provided with cooling channels according to a first embodiment of the invention.
Figure 2:
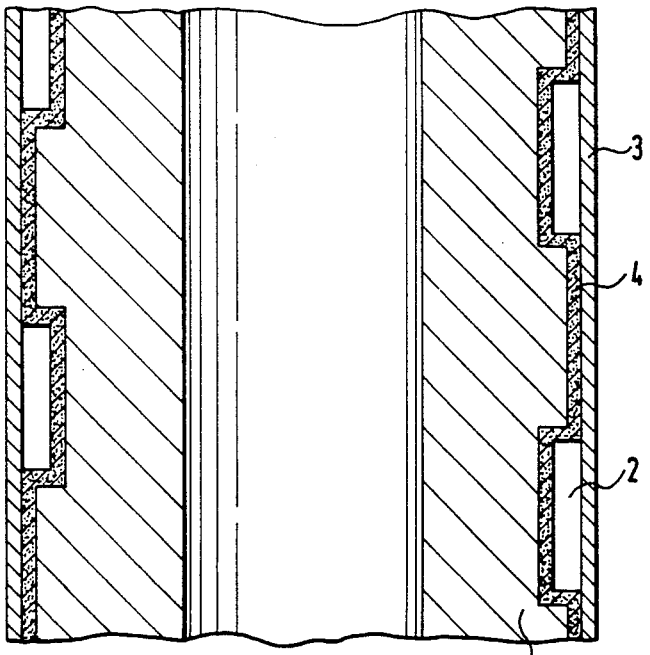
FIG. 2 is a longitudinal sectional view of the gun barrel of FIG. 1.

FIGS. 1 and 2 disclose a first embodiment of the gun barrel with a cooling arrangement according to the invention. As shown the gun barrel is composed of a tubular wall 1 which is provided with cooling channels 2 which are formed in the outer surface of wall 1 and extend helically around the circumference of the gun barrel. In this embodiment, the cooling channels 2 are formed by grooves formed directly in the outer surface of the barrel wall in the manner of external rifling. The grooves forming the cooling channels 2 are sealed toward the exterior by a thin-walled tube 3 pushed over the gun barrel. As the material for the outer tube or skin 3, a metal can be used which preferably has a rather high thermal conductivity, e. g. copper, brass, aluminium, alloys of low grade steel. The thickness of this tube 3 may range between 0.5mm and 6mm, depending on the material used.

As shown, the gun barrel with the grooves cut therein is preferably coated with a thermal insulation layer 4 before the outer tube 3 is pulled over so that the outer surface of the gun barrel is coated with thermal insulation. This layer 4 may be composed, for example, of a ceramic material which is sputtered on by means of a plasma spraying process. The ceramic or thermal insulating layer 4 may range in thickness for 0.1 mm up to several mm.

Figure 3:
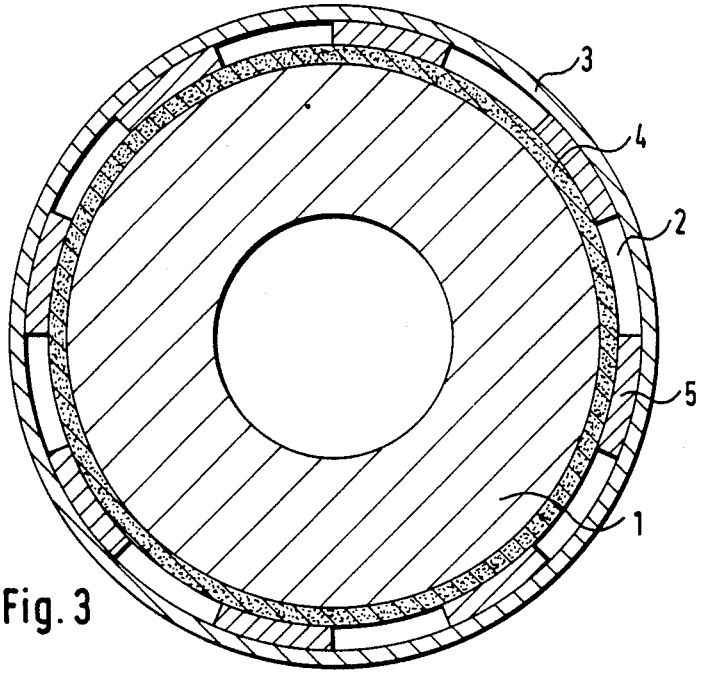
FIG. 3 is a cross-sectional view of a gun barrel provided with cooling channels according to a second embodiment of the invention.
Figure 4:
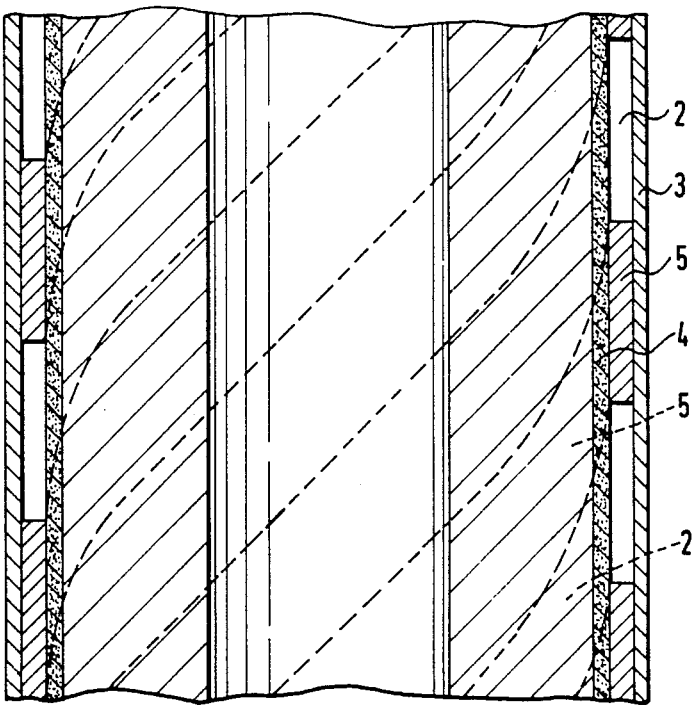
FIG. 4 is a longitudinal sectional view of the gun barrel of FIG. 3 with the helical cooling channels indicated.

FIGS. 3 and 4 show a further embodiment wherein the cooling channels 2 are formed of supporting webs 5 which are applied to the outer surface of the gun barrel in helical form and then the thin-walled tube 3 is pushed over them. Here again, a thermal insulation layer 4 is provided which, as shown, preferably covers the outer surface of the gun barrel, but which could be disposed so as to cover only the interior surface of cooling channels 2. In FIG. 4, the helical cooling channels 2 are clearly indicated. The material from which the supporting webs 5 are formed can be a metal with rather low thermal conductivity, as high grade steel, or a heat resistant, fiber reinforced plastic material. The radial thickness of the supporting webs 5 is between 2mm and about 20mm.

Figure 5:
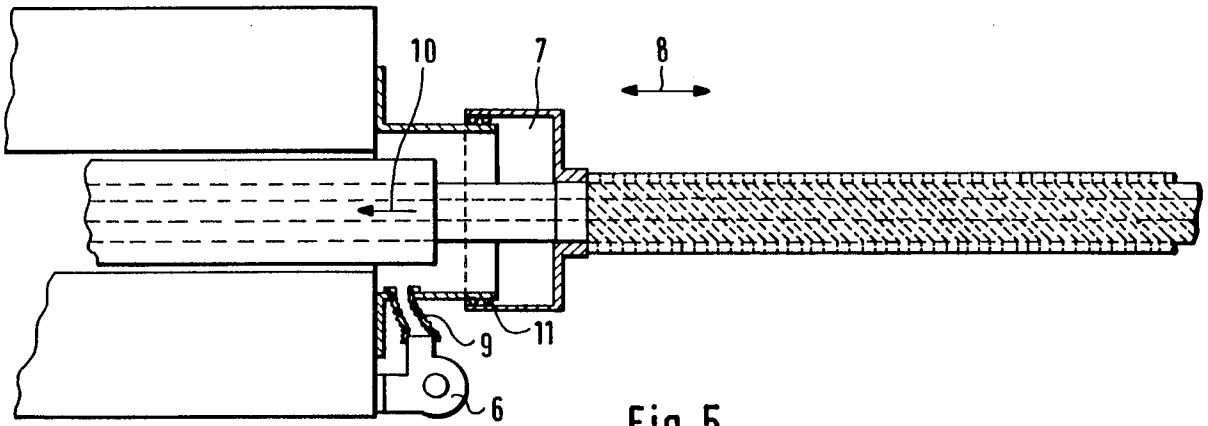
FIG. 5 is a schematic side view, partially in section, of a gun barrel with a cooling arrangement according to the invention and showing the barrel support and other components.

FIG. 5 shows the connection of the Cooling channels 2 to a blower mechanism 6 for supplying a stream of cooling air to the channels 2. For this purpose, a housing defining an air distribution chamber 7 is provided with the housing being connected between the gun barrel and a member, which does not move during recoil, e. g., the gun support, and being expandable and collapsible in the manner of a telescope in the direction of double arrow 8. The telescopic characteristics of the housing defining the air distribution chamber 7 allows it to be correspondingly pushed together during recoil of the gun barrel. The recoil direction is indicated by arrow 10. To allow for the continued expansion and collapse, the distribution chamber housing may be formed, if desired of a flexible material in the manner of a bellows. The blower mechanism 6 is preferably mounted at a location that does not move during recoil of the gun barrel. To permit such a mounting, preferably the blower mechanism 6 is connected as to the housing of the air distribution chamber 7 by a flexible hose connection 9.

Figure 6:
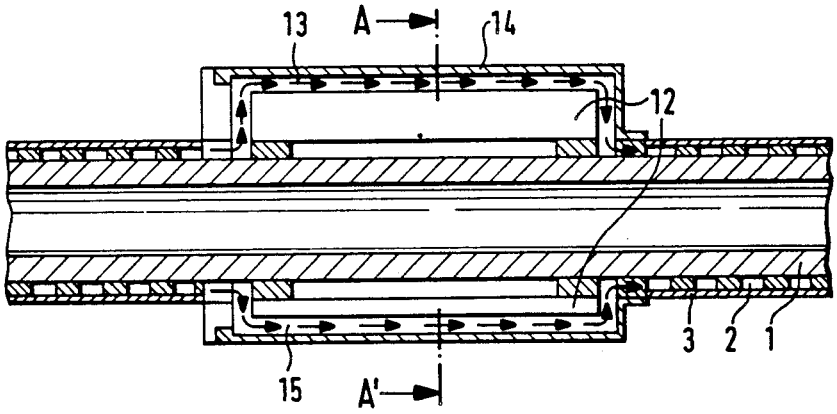
FIG. 6 is a schematic longitudinal sectional view of a gun barrel equipped with a smoke extractor and with a cooling arrangement according to the invention.
Figure 7:
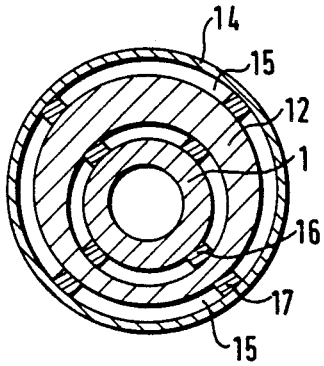
FIG. 7 is a cross-sectional view along line A—A' of FIG. 6.

FIG. 5 thus illustrates that the blower mechanism 6, which can operate with compressed air or suction, blows or sucks air through the cooling channels 2 via appropriate inlet openings which communicate with the cooling channels 2 at the frontal end wall of the housing of the distribution chamber 7. To allow free flow of air through the cooling channels 2, the cooling channels 2 are open at the front end of the gun barrel and thus are in communication with the atmosphere The telescopic connection of distribution chamber housing is marked with the reference numeral 11. The telescopic housing of the air distribution chamber 7 is sized so that it does not contact the flexible hose connection 9 upon recoil of the gun barrel FIGS. 6 and 7 show the addition of a smoke extractor with its housing 12 which, in a conventional manner, has been pushed over the gun barrel. In order to be able to cool the outer surface of the smoke extractor housing 12 and complete the air flow via the cooling channels 2, a further outer tube-like housing member 14, which is a separate component independent of the actual smoke extractor, is provided. As shown, this member 14 surrounds the smoke extractor housing 12, is connected at its ends to the tube 3 and is spaced from the smoke extractor housing 12 in both the radial and longitudinal directions to define a further intermediate distribution chamber or passage which bridges the smoke extractor housing 12 and through which the cooling air in the cooling channels 2 can flow. As can be seen in FIG. 6, the cooling air flows from the cooling channels 2 along the interior of outer tube member 14 in the direction of arrows 13 and then back into the cooling channels 2, thereby maintaining the cooling effect for the gun barrel and at the same time bridging the smoke extractor housing 12. During such passage, the cooling air passes through an annular chamber 15 formed between outer tube member 14 and the smoke extractor housing 12. Therefore, the area of the smoke extractor is included in the areas of the gun barrel being cooled.

As shown in FIG. 7, additional longitudinal webs 16 are provided between the outer surface of the gun barrel and the smoke extractor housing 12 to support the smoke extractor housing 12 on the gun barrel, and longitudinal webs 17 are provided between the housing 12 and the tube member 14 to support the outer tube member 14 against the exterior of the smoke extractor housing 12. Moreover, as can be seen from FIG. 6, the outer tube member 14 and smoke extractor 12 can be pushed off the gun barrel toward the front similarly to the way this is accomplished for cleaning or repair work in prior art gun barrels equipped with smoke extractors.

It will be understood that the above description of the present invention is susceptible to various modifications, changes and adaptations, and the same are intended to be comprehended within the meaning and range of equivalents of the appended claims.

What is claimed is:

1. An arrangement for cooling a gun barrel, comprising:

a gun barrel having an outer surface; means for forming a plurality of cooling channels which extend helically around said outer surface of said gun barrel for the passage of a cooling fluid through said channel; and a layer of thermal insulation material disposed on and circumferentially extending around said outer surface of said gun barrel, with said layer being disposed at least on an inner circumferential surface of each of said cooling channels.

2. An arrangement as defined in claim 1, wherein said means for forming said cooling channels comprises a plurality of helical grooves which are cut into said outer surface of said gun barrel, and an outer tube coaxially disposed around and pulled over said gun barrel and sealing said grooves.

3. An arrangement as defined in claim 2, wherein said layer of thermal insulation material covers said outer surface of said gun barrel.

4. An arrangement as defined in claim 1, wherein said means for forming said cooling channels comprises a plurality of supporting webs extending helically around said outer surface of said gun barrel and an outer tube coaxially disposed around and pulled over said gun barrel and sealingly contacting said webs.

5. An arrangement as defined in claim 4, wherein said layer of thermal insulation material covers said outer surface of said gun barrel and said supporting webs are disposed on said insulating layer.

6. An arrangement as defined in claim 1, wherein said means for forming said cooling channels comprises an outer tube coaxially disposed around and pulled over said gun barrel, and a plurality of helically extending grooves cut into said inner surface of said outer tube.

7. An arrangement as defined in claim 6, wherein said layer of thermal insulation material covers said outer surface of said gun barrel and said inner surface of said outer tube contacts said insulation layer.

8. An arrangement as defined in claim 1 further comprising means, including a housing defining an air distribution chamber disposed adjacent a rear end of said gun barrel and operatively connected with said cooling channels, for charging said cooling channels with cooling air.

9. An arrangement as defined in claim 8 wherein said housing is connected between said gun barrel and a support member which is not subjected to recoil movement of said gun barrel, and said housing includes wall means for permitting contraction of a volume of said housing upon recoil movement of said gun barrel.

10. An arrangement as defined in claim 9, wherein said wall means has a telescopic configuration.

11. An arrangement as defined in claim 9, wherein said wall means includes flexible walls.

12. An arrangement as defined in claim 9, wherein said means for charging further includes a cooling air blower connected with said air distribution chamber housing via a flexible conduit, and said cooling air blower is mounted on a support which is not subjected to the recoil movement of said gun barrel.

13. An arrangement as defined in claim 9, wherein said means for charging further includes a cooling air blower connected to said distribution chamber housing via a flexible conduit.

14. An arrangement as defined in claim 1, further comprising: a smoke extractor mounted on and surrounding said outer surface of said gun barrel; and means, mounted on said gun barrel and including an outer tube member which surrounds said smoke extractor, for defining an annular chamber which is in communication with said cooling channels and bridges said smoke extractor to permit cooling air to flow around said smoke extractor.

15. An arrangement as defined in claim 2 wherein said outer tube is formed of a metal.

16. An arrangement as defined in claim 4 wherein said webs are formed of a material with a low thermal conductivity and said outer tube is formed of a metal with a high thermal conductivity.

17. An arrangement as defined in claim 1 wherein said layer of thermal insulating material has a thickness of at least approximately 0.1 mm.

18. An arrangement as defined in claim 1 wherein said insulating material is a ceramic material.

19. An arrangement for cooling a gun barrel, comprising:

a gun barrel having an outer surface; means for forming a plurality of closed cooling channels which extend helically around said outer surface of said gun barrel for passage of a cooling fluid through said channel; and a layer of thermal insulation material disposed directly on and covering said outer surface of said gun barrel, so that said layer is disposed between said outer surface and said cooling channels.

* * * * *